US005913929A

United States Patent [19]

Gustafsson et al.

[11] Patent Number: 5,913,929

[45] Date of Patent: Jun. 22, 1999

[54] BENDING ARRANGEMENT FOR ALUMINUM PROFILE

[75] Inventors: Jukka Gustafsson, Mynämäki; Jouko Kara, Raisio; Ensio Koskinen, Masku; Ontrei Sarpaneva, Turku, all of Finland

[73] Assignee: Kvaerner Masa-Yards Oy, Helsinki, Finland

[21] Appl. No.: 08/822,806

[22] Filed: Mar. 24, 1997

Related U.S. Application Data

[63] Continuation-in-part of application No. 08/631,456, Apr. 12, 1996, abandoned.

[30] Foreign Application Priority Data

Apr. 13, 1995 [FI] Finland ..... 951826

[51] Int. Cl.[6] ..... B21D 7/14

[52] U.S. Cl. ..... 72/31.1; 72/420; 72/702

[58] Field of Search ..... 72/31.1, 384, 389.5, 72/420, 421, 453.08, 702

[56] References Cited

U.S. PATENT DOCUMENTS

| | | | |
|---|---|---|---|
| 3,333,445 | 8/1967 | Mergler et al. . | |
| 3,459,018 | 8/1969 | Miller | 72/384 |
| 3,889,513 | 6/1975 | Iwasaki et al. | 72/383 |
| 4,864,509 | 9/1989 | Somerville et al. | 72/702 |
| 5,060,495 | 10/1991 | Naoomi et al. | 72/31.1 |

FOREIGN PATENT DOCUMENTS

| | | | |
|---|---|---|---|
| 0 291 567 | 11/1988 | European Pat. Off. . | |
| 33 09 570 | 9/1984 | Germany . | |
| 6-91329 | 4/1994 | Japan . | |
| 1430153 | 10/1988 | Russian Federation . | |
| 1 334 589 | 10/1973 | United Kingdom | 72/124 |
| 1334589 | 10/1973 | United Kingdom . | |
| 2193129 | 2/1988 | United Kingdom . | |
| 2216442 | 10/1989 | United Kingdom . | |

OTHER PUBLICATIONS

Patent Abstracts of Japan, vol. 11, No. 028 (M–557), Jan. 27, 1987 (JP 61–199518, Hitachi Zosen Corp), Sep. 4, 1986.

Patent Abstracts of Japan, vol. 11, No. 028, (M–557), Jan. 27, 1987 (JP 61–199517, Hitachi Zosen Corp), Sep. 4, 1986.

Patent Abstracts of Japan, vol. 17, No. 503, Sep. 10, 1993 (JP 05–131330, Amada Co. Ltd.), May 28, 1993.

*Primary Examiner*—Lowell A. Larson

*Attorney, Agent, or Firm*—Smith-Hill and Bedell

[57] ABSTRACT

In a press bending arrangement for an aluminum profile, especially for manufacturing the equator profile for an LNG-tank, the press is connected to control and measuring devices in such a manner, that the reflection of the workpiece is taken into account both in bending the profile and in determining the bending control based on measurements being made.

17 Claims, 1 Drawing Sheet

BENDING ARRANGEMENT FOR ALUMINUM PROFILE

CROSS-REFERENCE TO RELATED APPLICATION

This application is filed as a continuation-in-part of U.S. patent application Ser. No. 08/631,456 filed Apr. 12, 1996. Now abandoned.

BACKGROUND OF THE INVENTION

The invention relates to a bending arrangement for aluminum profile.

Spherical tanks used for storage and transport of liquefied gas are large, normally about 40 m in diameter and are made of aluminum alloy. As used herein, the term "aluminum" includes an aluminum alloy suitable for use in fabrication of a spherical tank for storage and transport of liquefied gas, particularly liquefied natural gas. At the equator area of a large spherical tank, a special profile is used, which has to be formed to the desired curvature by press bending straight workpieces. The equator profile workpieces that are bent are normally about 15 m in length and about 1 m in height and have a thickness of close to 200 mm and a mass of more than 5000 kg. The completed workpiece must meet high demands with respect to dimensional accuracy. Because of the size of the workpiece, bending, check measuring and final control of the bending is difficult to perform. In particular the reflection or springback of the workpiece must be taken into account in the measuring and bending process. Also accurate moving of the workpiece in the press is difficult due to its great weight. Furthermore, the equator profile is asymmetric in cross-section relative to a central horizontal plane, typically being thicker at points below the central plane than at corresponding points above the central plane. Consequently, there is a tendency for the profile to twist during the bending process and so it is generally necessary either to take special steps to prevent twisting during the bending process or to carry out correction steps to remove the twisting after the bending process.

Prior art bending arrangements are disclosed in e.g., U.S. Pat. No. 3,333,445 and Japanese Publications JP 61199517 and JP 61199518. These arrangements relate to bending of generally symmetric workpieces taking into account reflection or springback already during the bending stage. Prior art measures for controlled movement of the workpiece are disclosed in Japanese Publication JP 5131330.

SUMMARY OF THE INVENTION

The object of the invention is to provide a bending arrangement, by means of which the work phases of bending, measuring and adjustment bending, i.e. taking into account both reflection or springback as well as twisting, of an equator profile may be accomplished in a particularly efficient manner in a single work station preferably so that all work phases are carried out in one process. A further object of the invention is to obtain easy and accurate workpiece movement in the bending press. Experience has shown that the use of an arrangement according to the invention in many cases more than doubles productivity. In addition, workpieces with accurate dimensions are achieved, which makes the assembly of a spherical tank much easier. Space is saved because a separate measuring station is not needed.

According to the present invention there is provided a bending arrangement for an aluminum profile, especially for manufacturing a so-called equator profile for a LNG-tank in a press, wherein the press is connected to control and measuring devices in such a manner that the reflection of the workpiece is arranged to be taken into account both in bending the profile and in determining the bending control based on measurements being made.

Since the reflection of the profile has been incorporated by means of calculation into the control program of the device, the desired bending result is normally achieved in only two bending phases. If the working program includes shape measuring of the curvature of the profile by means of measuring transducers after every press movement, deviations from the desired form are spotted immediately after each bending press movement. Adjustment actions may be carried out immediately. The bending of the profile may be accomplished using two bending tools, a female tool at the exterior of the bend and a male tool at the interior of the bend. In this case, the twisting of the asymmetric profile may be controlled during the bending procedure by using at least two power cylinders, one effective near one edge of the profile to be bent and the other near the opposite edge of the profile, to force the tools together. Automatic computer-governed calculations can be arranged to control the press and required corrective actions.

It is advantageous to use, in the computer, a so-called FEM-program, that is, a Finite Element Method program or the like, by means of which calculating and shape determining work and additional corrective actions may be determined, as known in the art, exactly and quickly. The program can take into account also workpiece material properties as well as the asymmetric cross-section of the profile so that correct bending is easily achieved. The bending process thus functions in a reliable manner and practically automatically.

In spite of the workpiece being big and heavy, it must be moved accurately at the work station. It may be moved in the press by means of motor driven transport rolls arranged close to the press jaws. Then only one worker is required for the whole bending and measuring process. It is important that the bending radius is accurate. This is obtained by moving the workpiece only a short distance, for instance 5–30 cm, and preferably about 10 cm, from one bending position to another. The movement distance of the workpiece is measured by a measuring wheel positioned close to the bending point. This wheel is in operational communication with the computerized control devices of the transport rolls. This gives a precise and fast movement that is almost fully automatic.

The workpiece may be supported by air cushion devices reducing to a minimum the friction forces resisting movement of the workpiece. If the press includes tools suitable for straightening excess bending, corrective actions can be done quickly in the same work station as the bending. Tools for straightening excess bending would correspond to the tools for bending the workpiece, except that their positions would be reversed relative to the bending plane of the workpiece and it would be necessary to take account of the asymmetry of the profile in the shape of the tools.

BRIEF DESCRIPTION OF THE DRAWINGS

The invention will now be described more in detail with reference to the accompanying drawing, in which.

DETAILED DESCRIPTION

Figure 1:
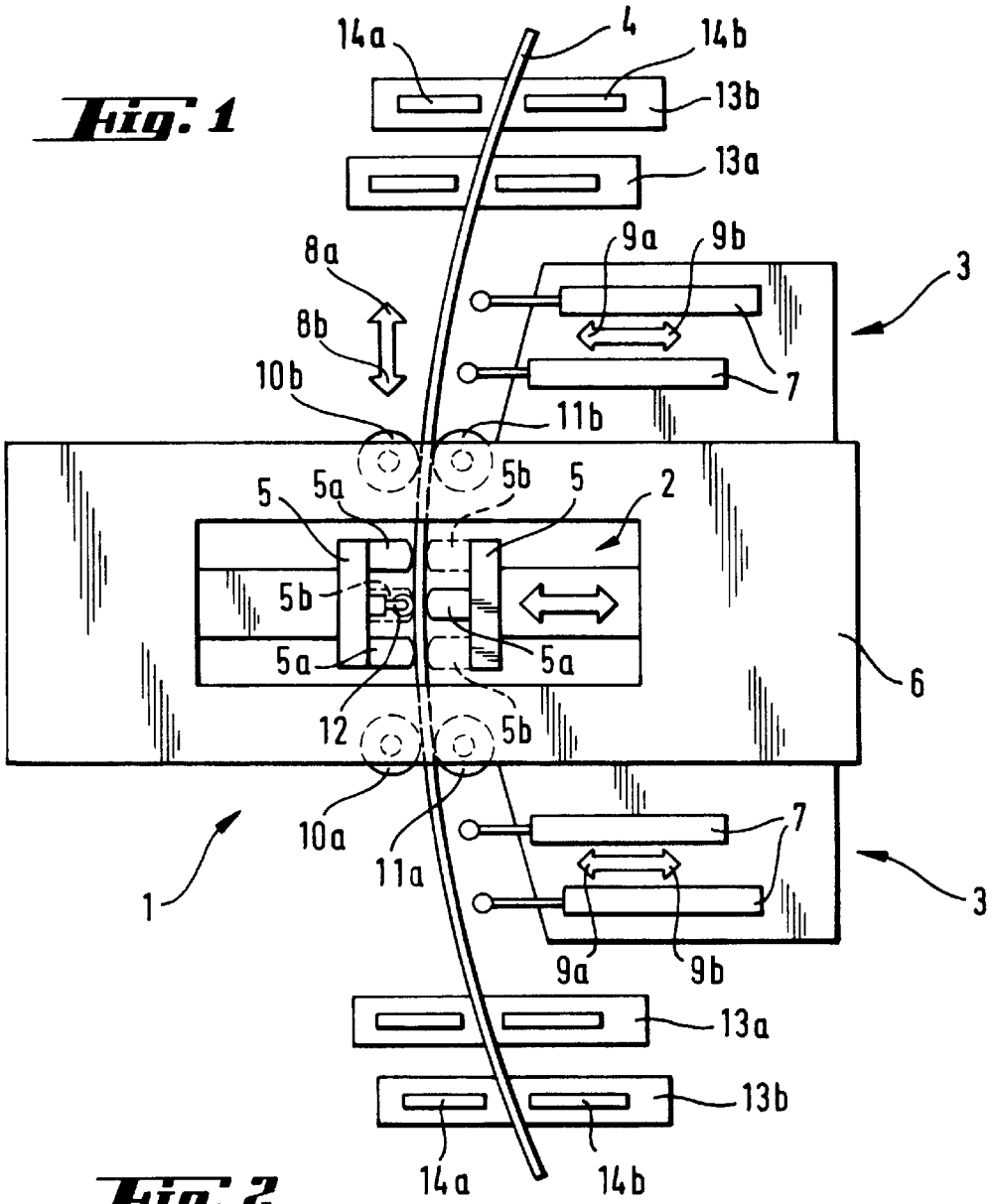
FIG. 1 schematically shows a top view of a bending arrangement according to the invention.
Figure 2:
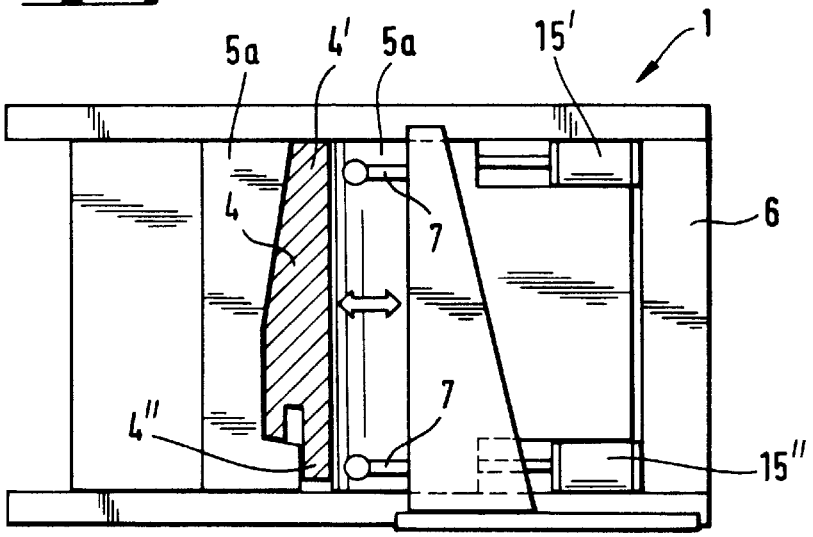
FIG. 2 shows a side view of the arrangement of FIG. 1, partly in section.

In the drawings, 1 indicates a measuring and bending station including a bending press 2, capable of exerting a press force of more than 5000 kN. There are measuring devices 3 for control of the bending of an equator profile 4 of a spherical tank and bending tools 5 adapted to the shape of the workpiece. The profile is of uniform cross-section over its length but is asymmetric relative to a central horizontal plane, i.e. a horizontal plane equidistant from the top and bottom edges of the profile. The press includes a rigid body 6 fixed to a steady base. The measuring devices 3 include measuring transducers 7 for measuring the workpiece, preferably at two measurement positions at each side of the bending position, and supplying their measurement values to a control unit (not shown) including a computer. As shown in FIG. 2, at each measurement position there are two transducers 7, one near the top edge of the profile and one near the bottom edge of the profile.

The profile 4 may be moved in the directions shown by the arrows 8*a* and 8*b*. The measuring transducers 7 are adjustable in the direction of the arrows 9*a* and 9*b*. For moving the profile 4 in the press 2, motorized transport roll pairs 10*a*, 11*a* and 10*b*, 11*b* are used. These rolls receive control commands either automatically from the control unit or by manual control. A secure function is obtained when there are transport rolls at both sides of the press. The rolls 11*a* and 11*b* are pressure rolls pressing the workpiece 4 steadily against the transport rolls 10*a* and 10*b*.

A measuring wheel 12 measures the longitudinal movement of the profile 4. At both sides of the press there are workpiece supports 13*a* and 13*b* carried by air cushion bases. The workpiece supports include lateral support elements 14*a* and 14*b* holding the workpiece in a vertical orientation. The supports 13*a*, 13*b* are easily movable on the floor so that they follow the workpiece and carry its weight.

The measuring transducers 7 may be made movable in a vertical direction for measuring the profile 4 at different heights. It is also possible to provide so many transducers 7 that there is no need for moving them vertically.

The press includes tools 5*a*, shown in solid lines, for bending the workpiece. The tools 5*a* include a female tool at the exterior of the bend in the workpiece and a male tool at the interior of the bend. The tools 5*a* are mounted in outer and inner tool carriers 5.

At the beginning of the bending process, one end of the profile 4 is placed in the press 2 in a first bending position and the other end of the profile is supported by two of the supports 13*a* and 13*b* at one side of the press. The measuring system including the transducers 7 is trimmed for action to monitor the bending and the reflection of the workpiece. Trimming of the measuring system includes calibrating the measuring system. The desired final curvature of the workpiece is supplied to the control unit, which calculates a bending radius on the basis of the desired final curvature and a theoretical springback value. The theoretical springback value depends on the material of the profile, the dimensions of the profile, and the bending radius. The component that depends on the material of the profile may be obtained from manufacturer's specifications or from experience with a previous workpiece, for example. The calculated bending radius is supplied to the bending press, which applies a bending force to bend the profile at the first bending position to the calculated radius. When the bending force is removed, the profile springs back toward its previous curvature, and the measuring transducers 7 are used to measure the actual curvature at the first bending position. The actual curvature is compared with the bending radius and an actual springback value is calculated. If the actual springback value differs substantially from the theoretical springback value, a corrected springback value for use in an adjustment bending step at the first bending position is calculated. This sequence of steps is repeated until the actual curvature at the first bending position is equal to the desired curvature, within a prescribed tolerance. Thus, if the bending must be corrected, either because the measured radius of curvature is too great or too small, the transducers 7 give required data for further bending action or for straightening action until the continuous measuring indicates a correct result. Then the profile 4 is shifted to the second bending position, which typically is at a distance of approximately 10 cm from the first bending position, and the sequence of bending and measuring is repeated at the second bending position until the curvature at the second bending position is equal to the desired curvature, within the prescribed tolerance. At the second bending position, the initial springback value is calculated on the basis of the measurements made at the first bending position, which reflect the material of the actual workpiece rather than the manufacturer's specifications or experience with another workpiece. Therefore, the initial springback value used at the second bending position is a better predictor of the behavior of the workpiece than the theoretical springback value that was used as the first bending position. The phases described are repeated over the whole length of the profile 4. During the progress of the work the air cushion carried supports 13*a* and 13*b* must from time to time be adjusted or increased or decreased in number. They may also be arranged to follow the workpiece automatically.

FIG. 2 shows two cylinders 15' and 15" which are arranged to drive the inner tool carrier, which carries the male bending tool 5*a*. The cylinders are spaced apart vertically so that the cylinder 15' acts on the male bending tool 5*a* in the vicinity of the upper edge 4' of the asymmetric profile 4 whereas the cylinder 15" acts on the male bending tool 5*a* in the vicinity of the lower edge 4" of the asymmetric profile 4. The tool carriers 5, and hence the bending tools 5*a*, are able to tilt about a horizontal axis perpendicular to the axes of the cylinders 15' and 15". Due to this arrangement it is possible to exert more pressure on one edge of the profile than on the other in order to prevent the profile from twisting during the bending operation. By taking measurements using the transducers 7 during the bending procedure, the control unit is able to supply the cylinders of the male bending tool with control signals for correcting the bending result and for preventing or correcting twisting of the profile.

Since the two transducers 7 at each measurement position are spaced apart vertically, the control unit can determine from the measurement values provided by the transducers whether the profile has twisted during the bending operation. In the event that the bending tools 5*a* are operated to prevent twisting, the measurement values can be used to verify that the profile has not twisted during the bending operation to an unacceptable extent.

It is of advantage to accomplish first a rough bending rather close to the final shape and then a finishing bending in a second phase. Thereby, a particularly good bending result is achieved. This may be accomplished by setting the tolerance for the actual curvature initially to a rather large value, for the rough bending, and then to a smaller value, for the second phase. By choosing the bending positions close to one another, the profile will be bent particularly accurately.

The press may include tools 5*b*, shown in broken lines, for straightening excess bending. The male and female tools 5*b* are similar to the male and female tools 5*a* used for bending the workpiece, except that the relative locations thereof are reversed with respect to the bending plane of the workpiece. Thus, whereas for bending the workpiece, the female tool 5*a* is at the exterior of the bend and the male tool 5*a* is at the interior of the bend, for straightening excess bending the female tool 5*b* is at the interior of the bend and the male tool 5*b* is at the exterior of the bend. Naturally, the surface configuration of each tool should conform to the side of the profile engaged by that tool.

The invention is not limited to the embodiments shown, but several modifications are feasible within the scope of the attached claims.

We claim:

1. A bending arrangement for bending an elongate aluminum workpiece to a substantially uniform curvature in a press, the workpiece having a central horizontal plane midway between first and second horizontal edges of the workpiece and the workpiece being thicker at points between the central horizontal plane and the first edge than at corresponding points between the central horizontal plane and the second edge, whereby the workpiece is of asymmetric cross-section relative to the central horizontal plane, one of the first and second edges being an upper edge of the workpiece and the other of the first and second edges being a lower edge of the workpiece, and the bending arrangement comprising:

a supporting and moving mechanism for supporting the workpiece and moving the workpiece longitudinally through the press, a bending means for bending the workpiece in separate bending operations at respective spaced-apart bending positions along its length, said bending means including at least one bending tool adapted to the asymmetric cross-section of the workpiece, a first power cylinder positioned to act on the workpiece along a substantially horizontal axis at a location adjacent the first edge of the workpiece and a second power cylinder positioned to act on the workpiece along a substantially horizontal axis at a location adjacent the second edge of the workpiece, and control and measuring devices associated with the press in such a manner that springback of the workpiece is arranged to be taken into account both in bending the workpiece and in determining the bending control based on measurements being made, said control and measuring devices including at least first and second transducers for engaging the workpiece at vertically spaced positions for measuring twisting of the workpiece.

2. An arrangement according to claim 1, wherein the press includes a control center for controlling the bending process and its correction, so that a measuring inspection of the bent workpiece follows every bending operation.

3. An arrangement according to claim 2, wherein the first and second transducers measure the shape of the workpiece close to the bending position for each bending operation, the first and second transducers being connected to the control center for comparison of the actual bending with the desired bending result, the control center being arranged to control the press to carry out any required additional bending, or rebending, taking into account springback and twisting of the workpiece.

4. An arrangement according to claim 1, wherein the first and second transducers are at a first measurement position along the workpiece, the arrangement further includes a measurement means at a second measurement position, which is spaced apart along the workpiece from the first measurement position, and said measurement means comprises at least first and second transducers for engaging the workpiece at vertically spaced positions and providing measurement values to the control device.

5. An arrangement according to claim 1, wherein the calculations for taking into account springback and twisting of the workpiece are based on a Finite Element Method program.

6. An arrangement according to claim 1, wherein the supporting and moving mechanism comprises transport rolls in the vicinity of the bending means.

7. An arrangement according to claim 1, wherein the supporting and moving mechanism comprises a mechanism for moving the workpiece longitudinally in steps of 5–30 cm, preferably 10–20 cm, from one bending position to a subsequent bending position.

8. An arrangement according to claim 1, comprising a measuring wheel in functional communication with the control and measuring devices for measuring movement of the workpiece from one bending position to another.

9. An arrangement according to claim 1, wherein the supporting and moving mechanism includes air cushion support elements for supporting the workpiece to facilitate ready movement of the workpiece.

10. An arrangement according to claim 1, wherein the bending means includes a tool carrier in which the bending tool is mounted and the arrangement further comprises a straightening tool which can be mounted in the tool carrier in place of the bending tool and used for straightening excess bending.

11. An apparatus for bending an elongate aluminum profile, which is of asymmetric cross-section relative to a central horizontal plane and has upper and lower edges, to a substantially uniform desired curvature value, comprising:

a control means responsive to the desired curvature value and a springback value for calculating a bending radius to which the profile should be bent, a bending press for receiving the profile and the calculated bending radius and executing a bending operation in which the bending press applies a bending force that bends a length segment of the profile to said bending radius, the bending press including at least one bending tool adapted to the asymmetric cross-section of the workpiece and first and second power cylinders positioned to act on the profile along respective substantially horizontal axes at locations adjacent the upper and lower edges respectively, a measuring means for measuring the curvature of said length segment of the profile after removal of bending force and supplying the measured curvature value to the control means, the measuring means including at least one transducer for engaging the workpiece, and a computation means for calculating a corrected springback value and supplying the corrected springback value to the control means for calculating a corrected bending radius.

12. A method for bending an asymmetric aluminum profile to a substantially uniform desired curvature value, comprising:

(a) calculating a bending radius to which the profile should be bent based on an initial curvature value, the desired curvature value and a springback value, (b) bending a length segment of the profile to said bending radius by applying bending force to the profile, the bending force being non-uniform perpendicular to the length of the profile in order to correct for a tendency of the aluminum profile to twist during the bending, (c) removing the bending force, whereby the length segment of the profile springs back toward the initial curvature, (d) measuring the curvature of the length segment of the profile after removal of bending force, and (e) calculating a corrected springback value based on the bending radius and the measured curvature value.

13. A method according to claim 12, further comprising:

(f) supplying the measured curvature value and the corrected springback value to step (a), (g) repeating steps (a)–(d), and (h) if the measured curvature value is substantially equal to the desired curvature value, terminating the method, and otherwise repeating steps (e)–(g).

14. A method according to claim 13, wherein steps (a)–(f) are applied to a first length segment of the profile and the method further comprises applying steps (a)–(f) to a second length segment of the profile.

15. An aluminum profile bent by a method according to claim 12.

16. A method for bending an asymmetric aluminum profile to a substantially uniform desired curvature value, comprising:

(a) calculating a bending radius to which the profile should be bent based on an initial curvature value, the desired curvature value and a springback value, (b) bending a length segment of the profile to said bending radius by applying bending force to the profile, (c) removing the bending force, whereby the length segment of the profile springs back toward the initial curvature, (d) measuring the curvature of the length segment of the profile after removal of bending force, and (e) calculating a corrected springback value based on the bending radius and the measured curvature value.

(f) supplying the measured curvature value and the corrected springback value to step (a), (g) repeating steps (a)–(d), (h) if the measured curvature value is not substantially equal to the desired curvature value, repeating steps (e)–(g), and otherwise (i) if the length segment of the profile is twisted, applying a correction force which is non-uniform perpendicular to the length of the profile in order to remove the twist.

17. A method according to claim 16, wherein steps (a)–(i) are applied to a first length segment of the profile and the method further comprises applying steps (a)–(i) to a second length segment of the profile.

* * * * *